United States Patent [19]

Yamada et al.

[11] Patent Number: 5,050,138

[45] Date of Patent: Sep. 17, 1991

[54] ELECTRONIC WRIST WATCH HAVING A SOUND PRODUCING UNIT AND AN ELECTROOPTIC DATA DISPLAY UNIT

[75] Inventors: Wataru Yamada, Tachikawa; Yukio Kido, Fussa; Hiroyuki Abe, Fussa; Shunji Minami, Fussa; Shigeru Katoh, Tachikawa; Junro Yano, Fussa, all of Japan

[73] Assignee: Casio Computer Co., Ltd., Tokyo, Japan

[21] Appl. No.: 486,785

[22] Filed: Mar. 1, 1990

Related U.S. Application Data

[63] Continuation-in-part of Ser. No. 443,081, Nov. 27, 1989, which is a continuation of Ser. No. 403,304, Sep. 5, 1989, abandoned.

[30] Foreign Application Priority Data

| | | | |
|---|---|---|---|
| Sep. 12, 1988 | [JP] | Japan | 63-226576[U] |
| Dec. 27, 1988 | [JP] | Japan | 63-168654[U] |
| Mar. 6, 1989 | [JP] | Japan | 1-24715[U] |
| Mar. 17, 1989 | [JP] | Japan | 1-29828[U] |
| Mar. 20, 1989 | [JP] | Japan | 1-30793[U] |
| Mar. 20, 1989 | [JP] | Japan | 1-30794[U] |
| Mar. 20, 1989 | [JP] | Japan | 1-30798[U] |
| Jun. 29, 1989 | [JP] | Japan | 1-165294[U] |

[51] Int. Cl.[5] ..... G04B 47/00; G04B 23/02

[52] U.S. Cl. ..... 368/10; 368/13; 368/72; 368/88; 379/110

[58] Field of Search ..... 368/10, 82-84, 368/76, 80, 88, 276, 13, 72-74, 223, 228; 379/110

[56] References Cited

U.S. PATENT DOCUMENTS

| | | | |
|---|---|---|---|
| 3,788,060 | 1/1974 | Kawamura | 368/250 |
| 3,998,045 | 12/1976 | Lester . | |
| 4,108,340 | 8/1978 | Conn | 224/4 E |
| 4,236,239 | 11/1980 | Imgruth et al. | 364/88 |
| 4,367,050 | 1/1983 | Grimm | 368/80 |
| 4,436,435 | 3/1984 | Ushikoshi | 368/71 |
| 4,444,513 | 4/1984 | Proellochs | 368/223 |
| 4,493,560 | 1/1985 | Fukutome | 368/250 |
| 4,769,836 | 9/1988 | Aihara . | |

FOREIGN PATENT DOCUMENTS

| | | |
|---|---|---|
| 60-86993 | 6/1985 | Japan . |

*Primary Examiner*—Vit M. Miska

*Attorney, Agent, or Firm*—Frishauf, Holtz, Goodman & Woodward

[57] ABSTRACT

An electronic wrist watch having a sound producing unit and an electrooptic data display unit, has a single flat plate member a lower surface of which is contacted with a user's hand, and a case member which is attached to one end of the plate member so as to be freely opened and closed over the plate member. A switch input section for data input is mounted on an upper surface of the plate member. An analog display unit for displaying time with hands, and a sound emitting section are mounted on the upper surface of the case member so as not to overlap each other. An electrooptic data display unit for displaying data is mounted on the lower surface of the case member. A sound producing unit and an electronic circuit for driving the analog display unit and the sound producing unit are housed in the case member. The sound producing unit is located under the sound emitting section in the case member, and the electronic circuit is electrically connected to the switch input section so as to cause the electrooptic data display unit to display data from the switch input section.

9 Claims, 10 Drawing Sheets

ELECTRONIC WRIST WATCH HAVING A SOUND PRODUCING UNIT AND AN ELECTROOPTIC DATA DISPLAY UNIT

CROSS-REFERENCES TO THE RELATED APPLICATIONS

This is a continuation-in-part application based on the U.S.S.N. 443,081 filed on Nov. 27, 1989, pending, and being a continuation application of U.S.S.N. 403,304 filed on Sept. 5, 1989, abandoned.

BACKGROUND OF THE INVENTION

1. Field of the Invention

The present invention relates to an electronic wrist watch having a sound producing unit and an electrooptic data display unit for displaying data.

2. Description of the Related Art

Modern electronic wrist watches are provided with a large number of additional functions. Disclosed in U.S. Pat. No. 4,769,836, for example, is an electronic wrist watch with an auto-dialer function, in which a desired phone number, among a large number of phone numbers previously memorized in a memory, is read out and displayed on a display unit by switching operation, and a dial sound corresponding to the read number is produced for an automatic telephone call. Disclosed in U.S. Pat. No. 3,998,045, moreover, is a voice wrist watch which can tell a present time through a synthetic voice by operating a switch.

The wrist watches of these types, however, require an electrooptic data display unit, a large-sized sound producing unit for producing a greatly clearly audible sound, and a large number of input switches for the input of phone numbers or messages. Accordingly, the outer shape of these conventional wrist watches are inevitably large-sized.

In an electronic wrist watch with a calculator disclosed in Published Unexamined Japanese Utility Model Application No. 60-86993, a case is constituted by upper and lower half cases to effect a reduction in external shape, the upper half case being coupled to one end of the lower half case so as to be freely opened/-closed. A liquid crystal display section for time display is arranged in the upper surface of upper half case, while a liquid crystal display panel for the calculator is arranged in the lower surface thereof. Further, a keyswitch section is arranged in the upper surface of the lower half case, and a circuit board, a battery, etc. are arranged inside thereof. A bottom opening of the lower half case is closed by means of a back cover.

In the electronic wrist watch constructed in this manner, although the planar shape of the case is relatively small, it has a substantial thickness for the following reasons. Since the keyswitches are arranged in the upper surface of the lower half case, which has an inside space for holding electronic components, the lower half case is constituted by two stacked plates, a lower plate on the wrist side and an upper plate on the switch side. Moreover, the upper and lower plates of the lower half case must be made thick enough to be prevented from being deformed so that the electronic components in the case are deformed or damaged when the keyswitch is strongly depressed. As a result, the lower half case, and hence, the whole watch case, cannot be very thin.

In a wrist watch having a calculator disclosed in U.S. Pat. No. 4,108,340, watch and calculator cases in which an analog display type watch and a calculator are respectively housed are fixed back to back, and a band is inserted in a through hole formed between the cases. The band can be freely reversed in the through hole. The two cases can be reversed on the band as needed so as to selectively set the analog watch or the calculator in the same direction as that of the surface of the band.

In such a watch, the planar shape of the two cases can be reduced in size. The thickness of the outer shape of the whole watch becomes large because the cases, each having therein a housing space for electronic components, are stacked on each other.

In a dual-display wrist watch disclosed in U.S. Pat. No. 4,444,513, moreover, a watch case is constituted by upper and lower half cases. An analog display portion is arranged in the upper half case, whereas an electrooptic data display unit and switches are arranged in the lower half case. The upper half case is coupled to the lower half case so as to be freely opened/closed. Similarly in this wrist watch, since the upper and lower half cases, each having therein a housing space for electronic components, are stacked on each other, the thickness of the outer shape of the whole watch becomes large.

None of these three disclosed wrist watches are incorporated with a sound producing unit. In the wrist watch with the dialer function or the voice wrist watch, however, a large-sized speaker for a clearly audible sound must be incorporated in its case, so that the case has a larger thickness than that of the above described wrist watches.

SUMMARY OF THE INVENTION

It is an object of the present invention is to provide an electronic wrist watch having a sound producing unit and an electrooptic data display unit, having a low profile, small watch case, in which the display section of the electrooptic data display unit can be increased in size, a large number of switches can be increased, and the sound producing unit of a large size can be incorporated therein.

In order to achieve the above object, an electronic wrist watch according to the present invention comprises: a single flat plate member having an upper surface on which a switch input section for data input is mounted, and a lower surface of which is contacted with a user's hand; a case member which is attached to one end of the plate member so as to be freely opened and closed over the plate member, the switch input section being exposed for operation by a user when the case member is opened; an analog display unit, mounted on the upper surface of the case member, for displaying time with hands; a sound emitting section mounted on the upper surface of the case member so as not to overlap the analog display unit; an electrooptic data display unit, mounted on the lower surface of the case member, for displaying data; a sound producing unit housed in the case member so as to be located under the sound emitting section; and an electronic circuit, housed in the case member, for driving the analog display unit and the sound producing unit, the electronic circuit being electrically connected to the switch input section so as to cause the electrooptic data display unit to display data from the switch input section.

According to the above described arrangement, since the switch input portion is mounted on the upper surface of the single plain plate member and the lower surface of which is contacted with a user's hand, the plate member can be made thin enough to be able to be slightly elastically deformed by means of the load of pressure on the switch input section, so that the outer shape of the wrist watch can be thinned. In the electronic wrist watch having the aforementioned construction, moreover, a large number of switches can be arranged, the electrooptic data display unit can enjoy a wide display area, and the sound producing unit may be of a large size.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1A:
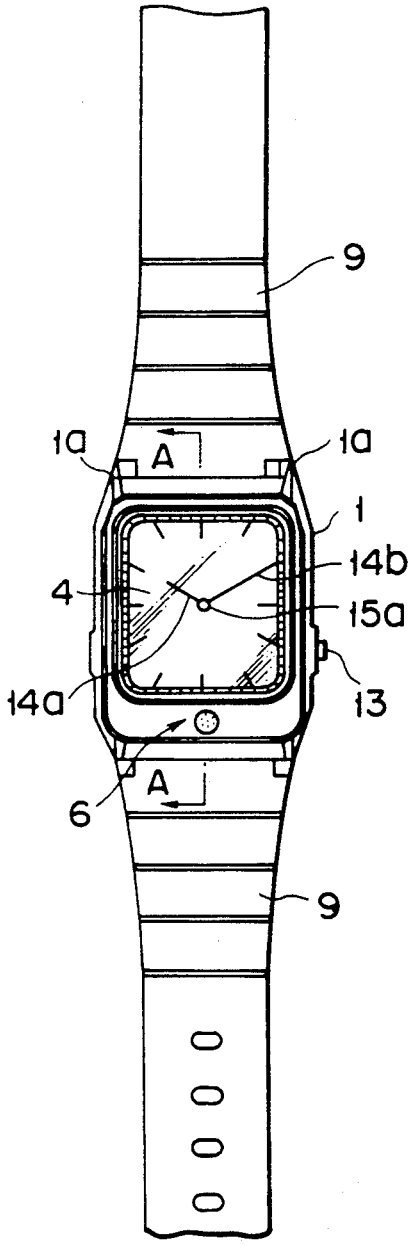
FIG. 1A is a plan view showing an electronic wrist watch according to a first embodiment of the present invention in a state wherein a case is closed.

A first embodiment of the present invention will be described below with reference to FIGS. 1 to 5.

An electronic wrist watch of the first embodiment is a dialer-function timepiece. As shown in FIGS. 1A, 1B, 2A and 2B, case 1 is attached to plate 2 by using pin 3 so as to be freely opened an closed. In this case, analog and digital display sections 4 and 5 are respectively mounted on the upper and lower surfaces of case 1. Sound emitting section 6 is provided at a position, located in the 6-o'clock direction of analog display section 4, on the upper surface of case 1.

Sheet switch 7 is arranged on the upper surface of plate 2. Switch 7 and digital display section 5 are electrically connected to each other through flexible wiring board 8. Watch bands 9 are respectively attached to the front and rear ends of plate 2. The respective members of the electronic wrist watch will be sequentially described below with reference to FIGS. 3 and 4.

Case 1 is made of metal such as stainless steel, synthetic resin, or the like and is constituted by upper and lower half cases 1*a* and 1*b*. Watch glass 10 is fitted in the upper surface of upper half case 1*a* through packing 9. Housing 11 in which analog and digital display sections 4 and 5 are housed, is arranged in case 1. Upper and lower half cases 1*a* and 1*b* are coupled to each other by screws 12. Note that push-button switch 13 is arranged on the periphery of case 1. Switch 13 is used to give a command for the start of production of a dial sound.

Analog display section 4 moves hands 14 to display time. Hand shaft 15*a* of analog movement 15 housed in housing 11 protrudes upward through center hole 16*a* in dial plate 16 arranged on the upper portion of housing 11. Hands 14 such as hour and minute hands 14*a* and 14*b* are attached to the upper end of hand shaft 15*a*, and hands 14 are moved above dial plate 16.

Digital display section 5 electrooptically displays data such as time and is constituted by a liquid crystal display panel (electrooptic data display element) 17, circuit board 18, and the like which are housed in housing 11. More specifically, liquid crystal display panel 17, is electrically connected to circuit board 18 through film board 20 and interconnector 21. Display panel 17 electrooptically displays various data, such as phone numbers, calculation results, etc., and corresponds to display glass 19 arranged at a predetermined position of lower half case 1*b*. Circuit board 18 includes a quartz oscillator and various electronic parts such as LSIs (not shown) required for calculation function, memory function, and the like and is placed at the center in housing 11. Note that battery cover 22 is arranged on one side of display glass 19 in lower half case 1*b*, and battery 23 is housed inside cover 22.

Dynamic speaker 24 is mounted inside upper half case 1*a* so as to correspond to sound emitting section 6 of case 1. Speaker 24 includes speaker case 24*a* which carries cylindrical magnet 24*b* on the inner bottom surface thereof. Magnet 24*b* is sandwiched between a pair of ring-shaped magnetic members 24*c* and 24*d* on either end surface thereof. An upper opening of speaker case 24*a* is covered by vibrating diaphragm 24*e*. Cylindrical coil 24*f* is mounted on the lower surface of diaphragm 24*e*. The lower end of coil 24*f* is inserted in a center hole of magnet 24*b*. The inner end of lower magnetic member 24*d*, which is located radially inner position than coil 24*f* of vibrating diaphragm 24*e*, rises up. Thus, coil 24*f* extends downward between the rising up portion of magnetic member 24*d* and the radially inner end of upper magnetic member 24*c*. Resonance space 25 is defined over vibrating diaphragm 24*e* of speaker 24 inside upper half case 1*a* so as to penetrate the upper surface of case 1*a*. An upper opening of space 25 is covered by protective member 26 which has a large number of holes.

Plate 2 is constituted by bottom plate 2*a* made of metal, such as stainless steel, and positioning member 2*b* of synthetic resin fixed thereon without a gap so that plate 2 is substantially single plate. Positioning member 2*b* is formed with switch housing recess 2*c*, screw head housing recesses 2*d*, in which the respective heads of screws 12 protruding from lower half case 1*b* of case 1 is inserted when case 1 is closed, and wiring board holding portion 2*e* holding flexible wiring board 8.

Band attaching portions 27 and 28 are respectively formed at both the ends of bottom plate 2*a* of plate 2. Of these band attaching portions 27 and 28, band attaching portion 27, which is positioned on the lower side in FIG. 4, has a pair of projections individually protruding from the right and left ends of the lower edge of plate 2. The proximal end of lower watch band 9 is placed between the paired projections of attaching portion 27, and the proximal end is attached to the paired projections of attaching portion 27 by using pin 3 inserted from the outside of the paired projections. Band attaching portion 28, which is positioned on the upper side in FIG. 4, also has a pair of projections individually protruding from those positions of the upper edge of plate 2 which are situated slightly inward from the right and left ends thereof. The proximal end of upper watch band 9 is placed between the paired projections of attaching portion 28, and a pair of attaching portions 29 of upper half case 1*a* are placed outside the paired projections of attaching portion 28. Case 1 and upper watch band 9 are pivotally attached to the paired projections of attaching portion 28 by using pin 3 inserted from the outside of the paired projections of attaching portion 28 in the same manner as described above.

Figure 4:
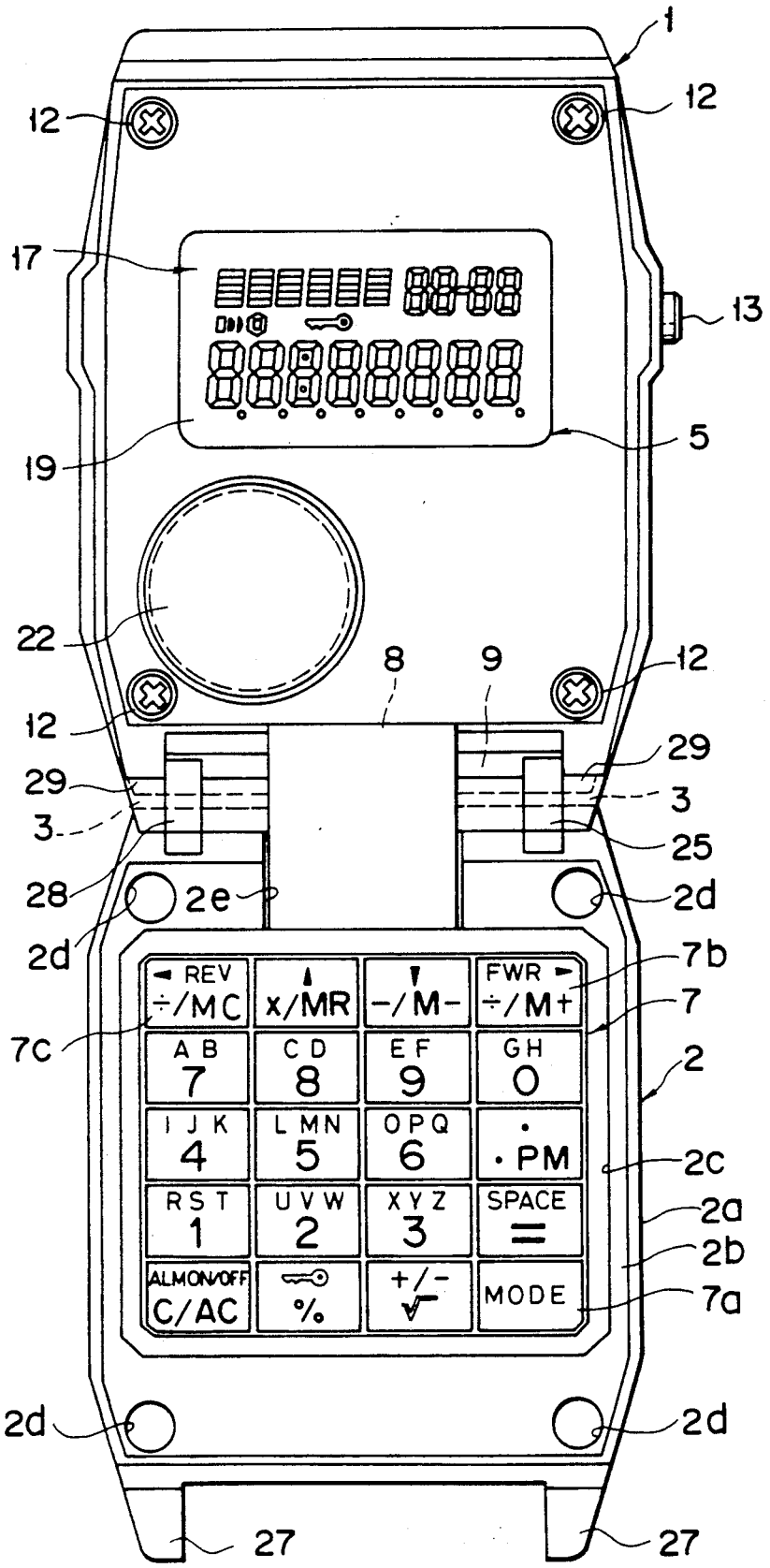
FIG. 4 is an enlarged view showing a main part of the electronic wrist watch in FIG. 2A.

Sheet switch 7 serves as a key input section and includes a large number of keys. Sheet switch 7 is arranged in switch housing portion 2*a* formed in the upper surface of plate 2. Switch 7 comprises a flexible film having a lower surface on which movable contacts are mounted in the form of a matrix, a spacer arranged on the lower surface of the flexible film and having openings at positions corresponding to the movable contacts, and a hard board mounted on the lower surface of the spacer and having stationary contacts which can be connected/disconnected to/from the movable contacts through the openings of the spacer. As shown in FIG. 4, a plurality of letter keys are assigned to the respective keys of sheet switch 7, such as ten-keys, function keys, etc. Mode key (MODE) 7*a* is arranged at a predetermined position (lower right corner) of sheet switch 7. A phone number mode and a calculation mode are cyclically set in electronic circuit 28 shown in FIG. 5 every time mode key 7*a* is depressed.

Flexible wiring board 8 electrically connects sheet switch 7 to circuit board 18 of digital display section 5. Board 8 is designed such that a large number of wires are formed into a pattern on a surface of a flexible film and are coated with an insulating material. One end of flexible wiring board 8 is connected to sheet switch 7. An intermediate portion of board 8 is located near the coupling portion of case 1 and plate 2. The other end of board 8 is inserted in case 1 and connected to circuit board 18 on base 26 in housing 11 through interconnector 31. Therefore, the intermediate portion of flexible wiring board 8 is elastically bent upon an opening/closing operating of case 1.

Figure 5:
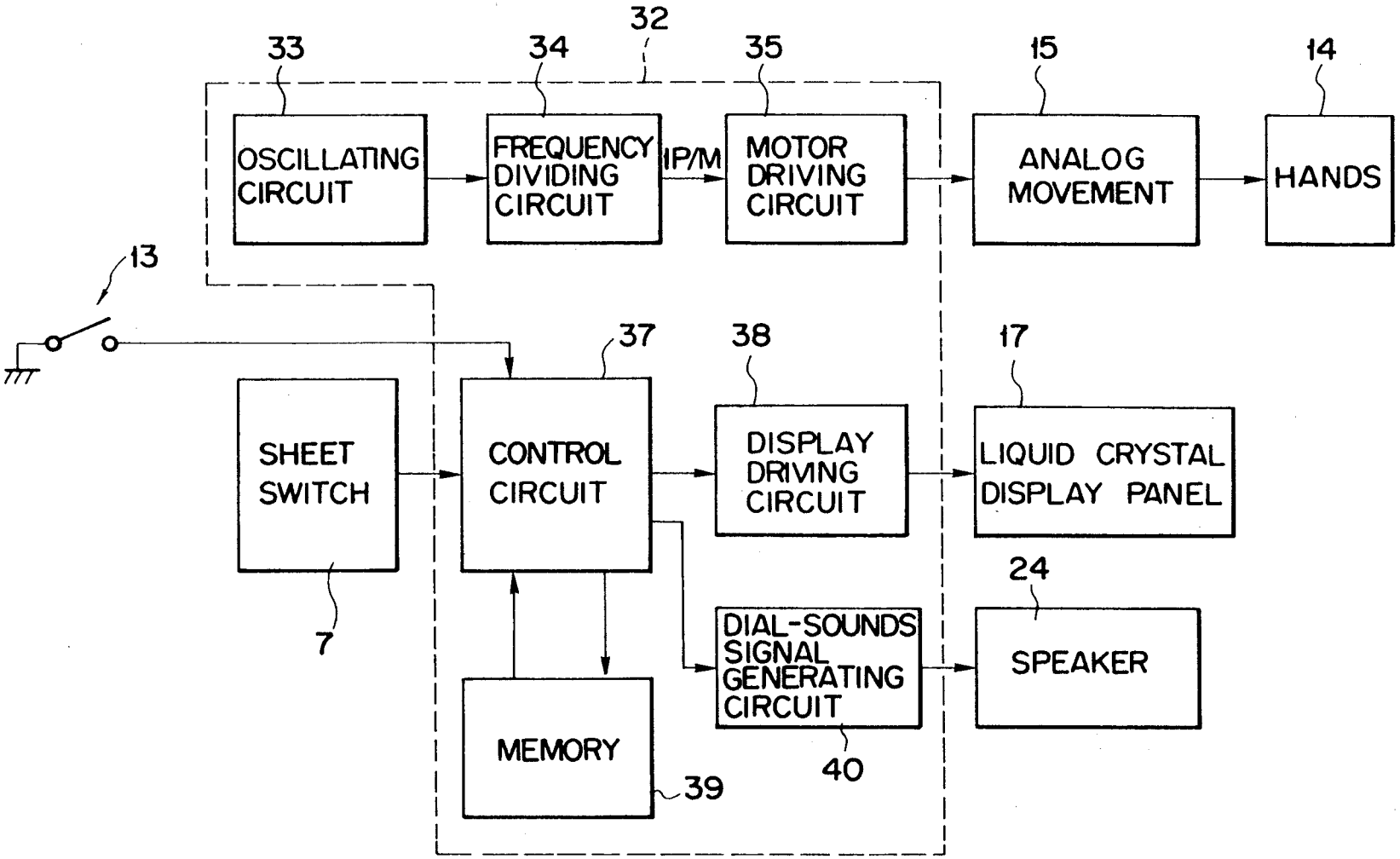
FIG. 5 is a block diagram showing a circuit arrangement of the electronic wrist watch in FIG. 1A.

FIG. 5 is a block diagram showing a schematic circuit arrangement of the electronic wrist watch of the first embodiment.

In FIG. 5, reference numeral 32 denotes an electronic circuit for driving analog display section 4, digital display section 5, and speaker 24. A reference signal delivered from oscillating circuit 33 is frequency-divided by frequency dividing circuit 34, and IP/M signals of one-minute period are delivered from circuit 34. The IP/M signals are supplied to motor driving circuit 35, which delivers drive pulses of one-minute period to a motor.

Control circuit 37 receives an output signal from sheet switch 7 and a control signal from switch 13. Also, circuit 37 is connected with memory 39. Memory 39 is memorized with a large number of phone number data along with name data. In response to the signal from sheet switch 7, control circuit 37 delivers the phone number data and name data, read from memory 39, or arithmetic data for the calculation function, to display driving circuit 38, thereby causing the liquid crystal display panel to display current time data or the phone number data and name data.

If switch 13 is operated when desired phone number data is displayed in the phone number displaying mode, control circuit 37 delivers the phone number data, read from memory 39, to dial sound signal generating circuit 40. Circuit 40 converts the inputted phone number data into a dial sound signal, and delivers the dial sound signal to speaker 24, as described in U.S. Pat. No. 4,769,836. Thereupon, speaker 24 is driven to produce a dial sound.

Figure 1B:
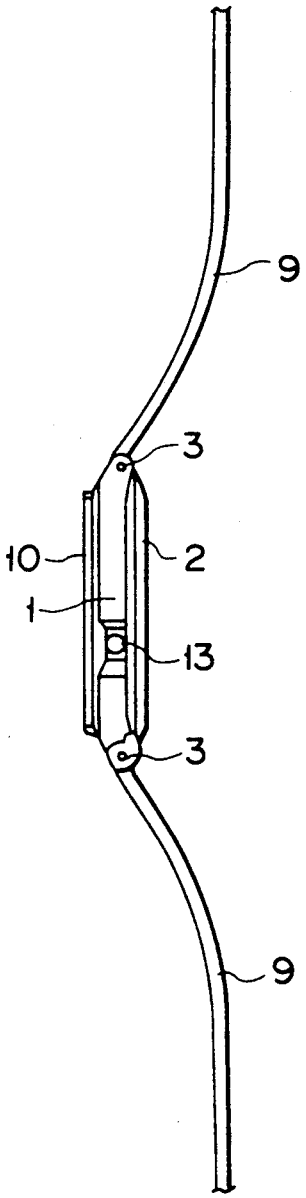
FIG. 1B is a side view showing the electronic wrist watch in FIG. 1A in a state wherein the case is closed.
Figure 2A:
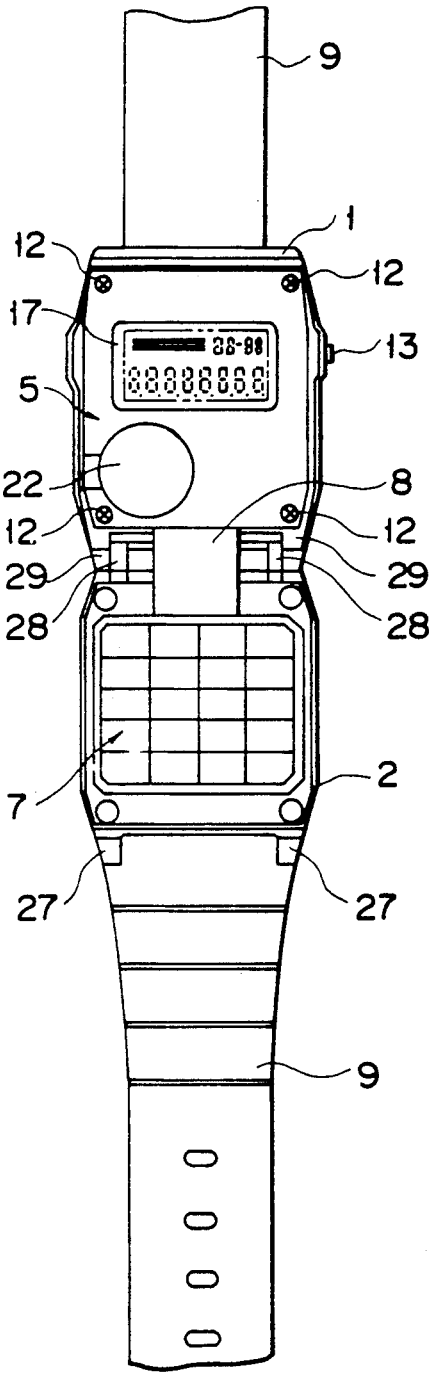
FIG. 2A is a plan view showing the electronic wrist watch in FIG. 1A in a state wherein the case is open.
Figure 2B:
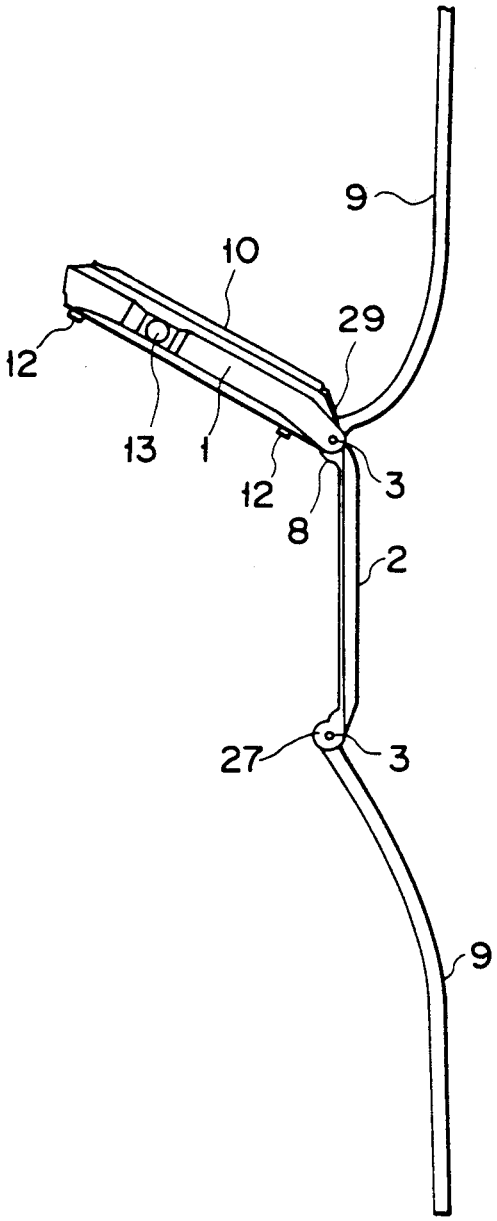
FIG. 2B is a side view showing the electronic wrist watch in FIG. 1A in a state wherein the case is open.
Figure 3:
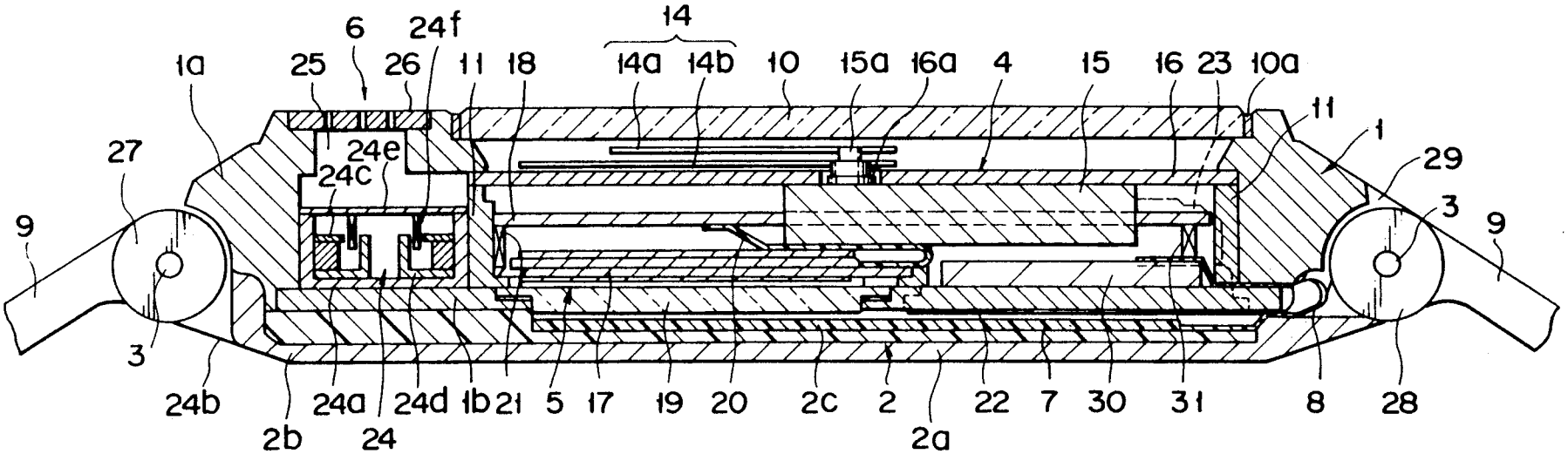
FIG. 3 is a sectional view taken along line A—A in FIG. 1A.

A method of using the electronic wrist watch having the above-described arrangement will be described below. First, if case 1 is pivoted to the closing position and is stacked on plate 2, the watch looks like a normal analog wrist watch, as shown in FIGS. 1A and 1B. In this case, time is indicated by hands 14, and the electronic wrist watch becomes compact in outer appearance and easy to carry. If case 1 is pivoted to the opening position and is separated from plate 2, digital display section 5 mounted on the lower surface of case 1 and sheet switch 7 mounted on plate 2 appear, as shown in FIGS. 2A, 2B and 4. In this case, when the respective keys of sheet switch 7 are operated, predetermined data can be displayed on liquid crystal display panel 17 of digital display section 5. For example, if mode key 7*a* of sheet switch 7 is repeatedly operated, the phone number mode and the calculation mode are cyclically set in electronic circuit 28. Data corresponding to the key operation in each mode is displayed on display panel 17.

In producing a dial sound for a telephone call, the phone number mode is established by means of mode key 7*a*, and the phone number data, along with the name data, are then displayed in succession on liquid crystal display panel 17 by operating forward (or alphabetical) search key 7*b* and reverse search key. A desired phone number can be selected while the data are being displayed in this manner. After the selection, case 1 is putted on plate 2, and sound emitting section 6 on the upper surface of case 1 is held against the receiver of a telephone. If switch 13 is operated in this state, the selected phone number data is supplied to dial sound signal generating circuit 40, so that a dial sound corresponding to the selected phone number is emitted from speaker 24.

In the electronic wrist watch according to the first embodiment, as described above, analog display section 4 and sound emitting section 6 are mounted on the upper surface of case 1, while digital display section 5 is mounted on the lower surface of the case. Further, sheet switch 7 is arranged on the upper surface of single plate 2, and case 1 is attached to plate 2 so as to be freely opened/closed.

Thus, sheet switch 7 is arranged on the upper surface of single flat plate 2 whose lower surface is to be contacted with a user's hand. Accordingly, plate 2 can be made thin enough to be able to be slightly elastically deformed when switch 7 is depressed, so that the outer shape of the wrist watch can be thinned, and a large number of switches can be arranged.

Moreover, analog and digital display sections 4 and 5 are arranged so as to vertically stack on sheet switch 7, so that they can enjoy a wide display area. As a result, display sections 4 and 5 are easy to see, and sheet switch 7 can be operated with improved efficiency.

Figure 6:
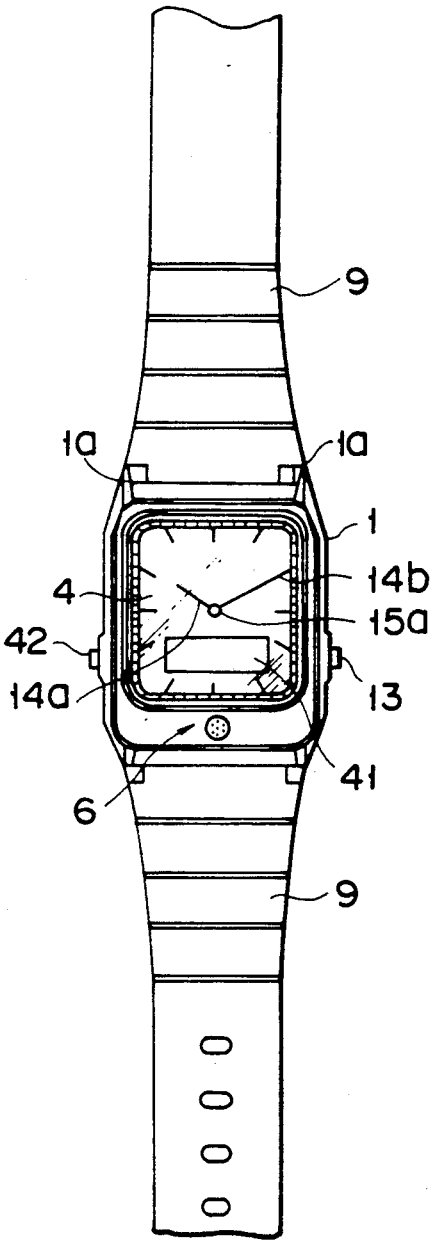
FIG. 6 is a plan view showing an electronic wrist watch according to a second embodiment of the present invention in a state wherein a case is closed.
Figure 7:
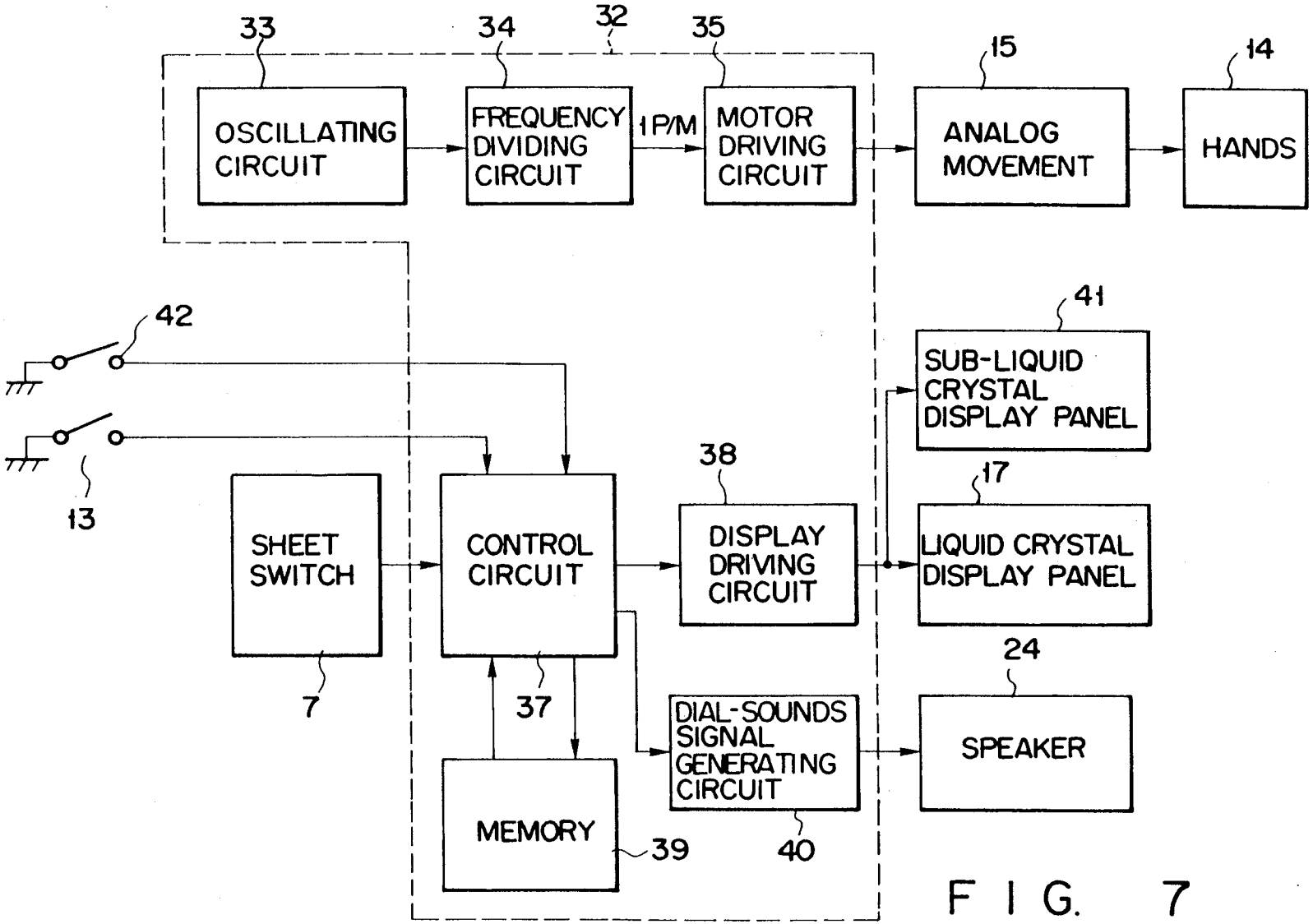
FIG. 7 is a block diagram showing a circuit arrangement of the electronic wrist watch in FIG. 6.

Referring now to FIGS. 6 and 7, a second embodiment of the present invention will be described. The same reference numerals used in the second embodiment denote to the same parts as in the first embodiment, and a description of these parts is omitted.

In an electronic wrist watch according to the second embodiment, analog display section 4 is provided with auxiliary liquid crystal display panel 41. Push-button switch 42 is arranged at a position located in the 9-o'clock direction on the side surface of case 1. By operating switch 42, the phone number data and name data memorized in memory 39 can be also sequentially selected and displayed on auxiliary display panel 41. A dial sound can be emitted from sound emitting section 6 by operating switch 13 while a desired phone number is being displayed on auxiliary liquid crystal display panel 41.

FIG. 7 is a block diagram showing a schematic circuit arrangement of the electronic wrist watch of the second embodiment.

In the second embodiment, an operating signal from switch 42 arranged at a position located in the 9-o'clock direction on the side surface of case 1 is inputted to control circuit 37. An output signal from display driving circuit 38 is supplied to both main and auxiliary liquid crystal display panels 17 and 41, so that the same data is displayed on both panels 17 and 41. Every time control circuit 37 receives the operating signal from switch 42, it alphabetically selects the phone number data and name data memorized in memory 39, and displays the selected data on liquid crystal panels 17 and 41.

The following is a description of a method of using the electronic wrist watch of the second embodiment with the aforementioned arrangement.

Usually, the wrist watch is used in a state in which case 1 is stacked on plate 2. In inputting the phone number data and name data, case 1 is opened to expose liquid crystal display panel 17 mounted on the lower surface of case 1, as shown in FIG. 4, and sheet switch 7 on the upper surface of plate 2. By operating some keys of sheet switch 7 in this state, the phone number data and name data can be memorized in memory 39 (FIG. 7). In producing a dial sound for a telephone call, switch 42 is operated with case 1 closed, whereby the phone number data and name data memorized in memory 39 are displayed in alphabetical order of names on auxiliary liquid crystal display panel 41. If switch 13 is operated while the desired phone number is being displayed, a dial sound indicative of the displayed data is emitted from sound emitting section 6.

Thus, in the electronic wrist watch according to the second embodiment, in contrast with the electronic wrist watch of the first embodiment, the desired dial sound can be produced without opening case 1.

Figure 8:
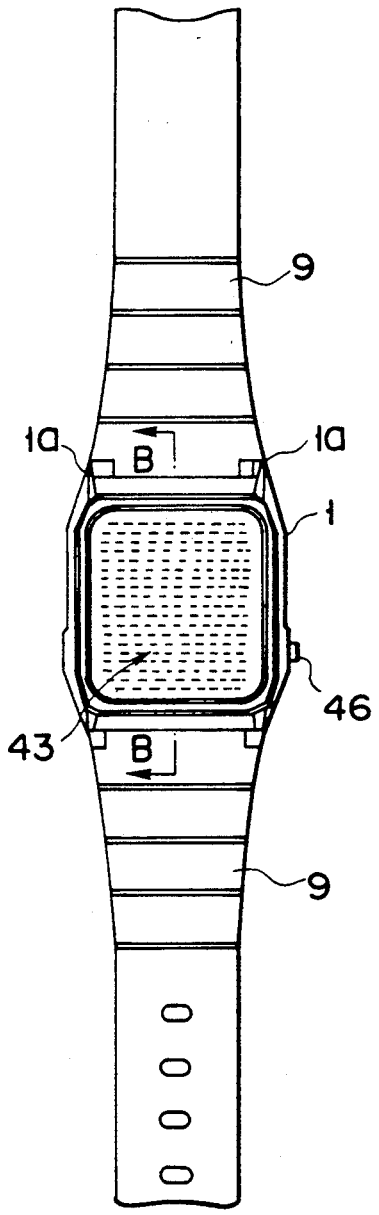
FIG. 8 is a plan view showing an electronic wrist watch according to a third embodiment of the present invention in a state wherein a case is closed.
Figure 9:
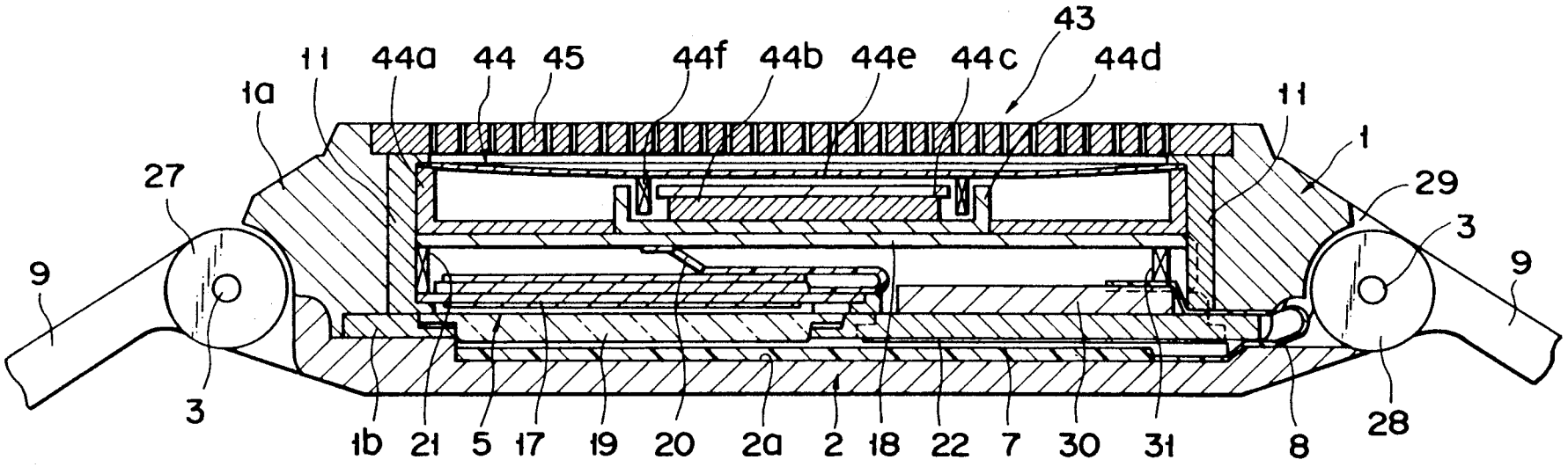
FIG.9 is a sectional view taken along line B—B in FIG. 8.
Figure 10:
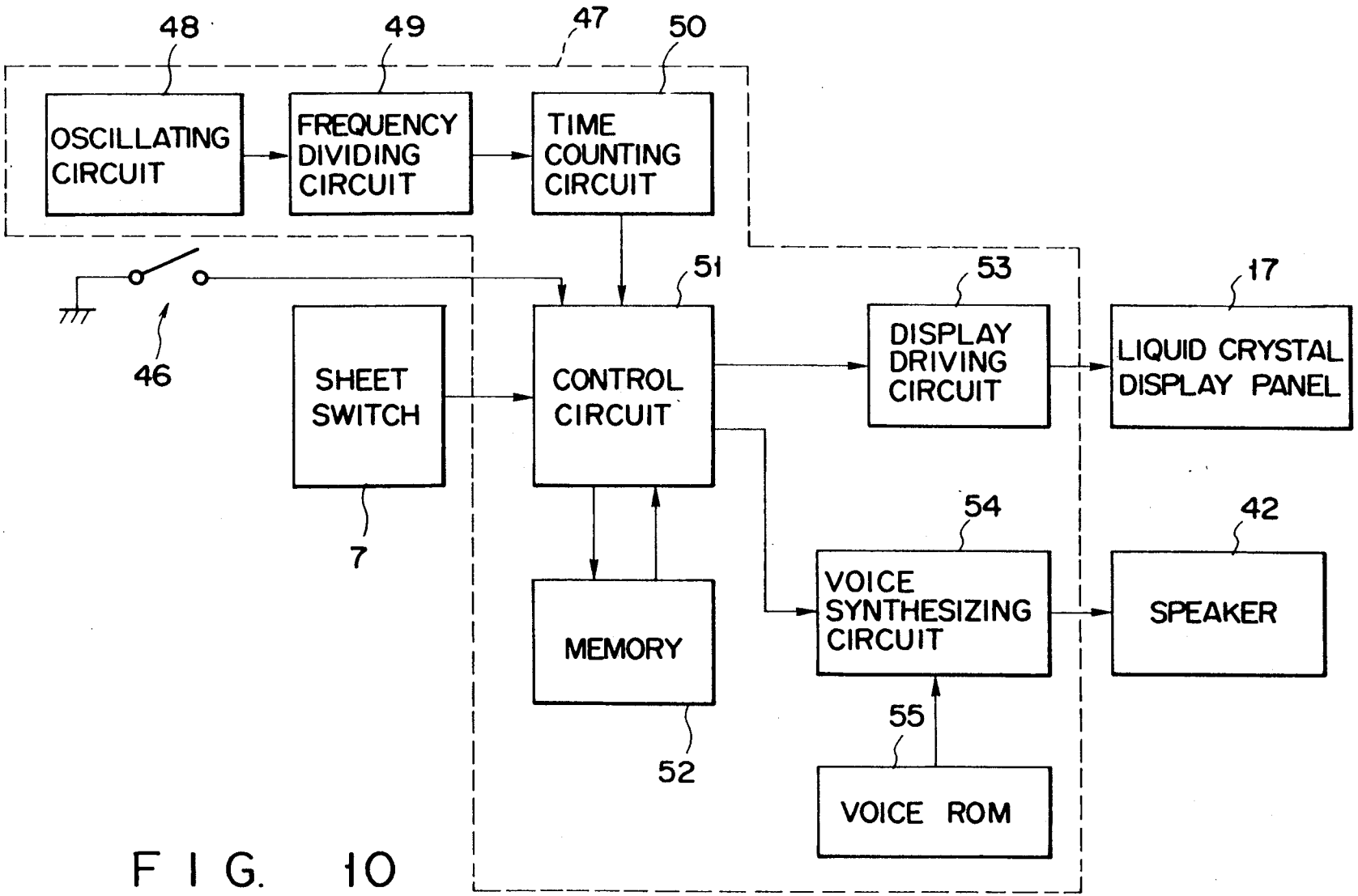
FIG. 10 is a block diagram showing a circuit arrangement of the electronic wrist watch in FIG. 8.

Referring now to FIGS. 8 to 10, a third embodiment of the present invention will be described. The same reference numerals used in the third embodiment denote to the same parts as in the first embodiment, and a description of these parts is omitted.

In the third embodiment, in contrast with the first embodiment, the analog display section is not arranged on the upper surface of case 1, but extensive voice producing section 43 is arranged so as to extend throughout the upper surface of the case. Voice producing section 43 not only produces a voice indicating the current time, but also emits an alarm sound at a preset alarm time.

As shown in detail in FIG. 9, dynamic speaker 44 is arranged above circuit board 18 inside upper half case 1*a*, and protective member 43 having a large number of holes is attached to a wide opening in the upper surface of upper half case 1*a*.

Push-button switch 46 is arranged on the side surface of case 1. If switch 46 is operated, a voice indicating the current time is delivered from voice producing section 43.

Speaker 44 includes speaker case 44*a* which carries disk-shaped magnet 44*b* on the inner bottom surface thereof. Magnet 44*b* is sandwiched between disk-shaped magnetic members 44*c* and 44*d* on either end surface thereof. An upper opening of speaker case 44*a* is covered by vibrating diaphragm 44*e*. Cylindrical coil 44*f* is mounted on the lower surface of diaphragm 44*e*. The lower end of coil 44*f* radially outwardly extends beyond the outer peripheral surface of magnet 44*b*. The radially outer end of lower magnetic member 44*d* rises up at a position radially outside of coil 44*f*. Thus, coil 44*f* extends downward between the rising up portion of magnetic member 44*d* and the radially outer end of upper magnetic member 44*c*.

In the present embodiment, plate 2 is constituted by only one metal plate.

FIG. 10 is a block diagram showing a schematic circuit arrangement of an electronic wrist watch according to the third embodiment.

In FIG. 10, reference numeral 47 denotes an electronic circuit for driving digital display section 5 and speaker 44. A reference signal delivered from oscillating circuit 48 is frequency-divided into 1P/S signals of one-second period by frequency dividing circuit 49. The 1P/S signals from circuit 49 are supplied to time counting circuit 50, which counts the 1P/S signals to obtain current time data, and supplies the time data to control circuit 51.

Control circuit 51 receives an output signal from sheet switch 7 and an operating signal from switch 46 on the side surface of case 1, as well as the aforesaid current time data. Also, circuit 51 is connected with memory 52. Memory 52 is memorized with a plurality of alarm time data along with message data. In response to the operating signal from sheet switch 7, control circuit 51 delivers the current time data from time counting circuit 50, or the alarm time data and message data read from memory 52, to display driving circuit 53. Thereupon, liquid crystal display panel 17 displays the current time data or the alarm time data and message data.

Control circuit 51 always compares the current time data from time counting circuit 50 and the alarm time data in memory 52. If the current time data and the alarm time data are equal, circuit 51 delivers the alarm time data and message data to display driving circuit 53, and causes liquid crystal display panel 17 to display an alarm time and a message. Control circuit 51 further delivers the alarm time data to voice synthesizing circuit 54. Circuit 54 converts the inputted alarm time data into a voice signal in accordance with voice data memorized in voice ROM 55, and supplies the voice signal to speaker 44. Thereupon, speaker 44 voices a message corresponding to the voice signal.

When control circuit 51 receives the operating signal from switch 46, it delivers the current time data from time counting circuit 50 to voice synthesizing circuit 54. Circuit 54 converts the inputted current time data into a voice signal in accordance with the voice data memorized in voice ROM 55, and supplies this voice signal to speaker 44. Thereupon, speaker 44 voices the current time corresponding to this voice signal.

The following is a description of a method of using the electronic wrist watch of the third embodiment with the aforementioned arrangement.

When case 1 is stacked on plate 2, only voice producing section 43 on the upper surface of case 1 can be seen from the upper side, as shown in FIG. 8. If switch 46 is operated in this state, the current time data from time counting circuit 50 is delivered to voice synthesizing circuit 54. Thereupon, circuit 54 converts the current time data into a voice signal, and supplies the voice signal to speaker 44. In response to the voice signal, speaker 44 voices the current time.

If the current time data and the alarm time data are equal, the alarm time data is delivered to voice synthesizing circuit 54, whereupon circuit 54 converts the alarm time data into a voice signal. This voice signal is delivered to speaker 54, which voices the alarm time corresponding to the voice signal.

In using the electronic wrist watch as a computer, or in memorizing the alarm time data and message data in memory 52, case 1 is opened to expose digital display section 5 on the lower surface of case 1 and sheet switch 7 on the upper surface of plate 2. By operating some keys of sheet switch 7 in this state, data corresponding to the key operation can be displayed on liquid crystal display panel 17 of display portion 5. Thus, the wrist watch can be used as a computer, or the alarm time data and message data can be memorized in memory 52.

In the electronic wrist watch according to the third embodiment, as described above, speaker 44 and digital display section 5 are respectively arranged on the upper and lower surfaces of case 1. Further, sheet switch 7 is arranged on the upper surface of single flat plate 2, and case 1 is attached to plate 2 so as to be freely opened/-closed.

Thus, sheet switch 7 is arranged on the upper surface of single flat plate 2 whose lower surface is contacted with a user's hand. Accordingly, plate 2 can be made thin enough to be able to be slightly elastically deformed, so that the whole wrist watch can be provided with a large number of switches despite its thinness.

Moreover, speaker 44, digital display section 5, and sheet switch 7 can be arranged overlapping one another, so that a wide display area can be secured. As a result, display section 5 is easy to see, and sheet switch 7 can be operated with improved efficiency.

Since speaker 44 can be made substantially as wide as the upper surface of case 1, in particular, it can produce a voice distinct enough for the wrist watch.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electronic wrist watch having a sound producing unit and an electronic data display unit, comprising:

plate member means having an upper surface on which a switch input section for data input is mounted;

case member means attached to an end of said plate member means so as to be freely opened and closed over said plate member means, said switch input section being exposed for operation by a user when said case member means is opened;

analog display means mounted on the upper surface of the case member means and having a motor and hands, the hands being moved on the basis of rotation of the motor to display present time;

electrooptic data display means, mounted on the lower surface of the case member means, for displaying data;

auxiliary electrooptic data display means disposed on the upper surface of said case member means;

sound producing means, arranged in said case member means at a position not to overlap said analog display means, for emitting sound in a direction toward said upper surface of said case member means;

electronic circuit means, housed in said case member means, for driving said analog display means and said sound producing means, said electronic circuit means being electrically connected to said switch input section so as to cause said electrooptic data display means to display data from said switch input section;

said electronic circuit means including phone number data memorizing means for memorizing a large quantity of phone number data; and read-out switch means provided in said case member means and being operable with said case member means closed, said read-out switch means being manually operable to sequentially read the phone number data from said phone number data memorizing means and to cause said auxiliary electrooptic data display means to display the phone number data read out from said phone number data memorizing means.

2. The electronic wrist watch according to claim 1, wherein said electronic circuit means further includes dialing tone starting switch means, capable of being operated with said case member means closed, for giving a command for a start of production of a dialing tone corresponding to the phone number data which is read by said read-out switch means and which is displayed on said auxiliary electrooptic data display means.

3. The electronic wrist watch according to claim 1, wherein said case member means comprises a coupling portion through which said case member means is coupled to a 12-o'clock-side end portion of said plate member means so as to be freely opened and closed, said case member means being freely opened and closed at the 12-o'clock side.

4. The electronic wrist watch according to claim 1, wherein:

said sound producing means is mounted aside from said analog display means and said electrooptic data display means so as not to be overlapped thereon, and the thickness of said sound producing means is substantially the same as the total thickness of said analog display means and said electrooptic data display means when both display means overlap each other.

5. The electronic wrist watch according to claim 1, wherein:

said analog display means comprises an analog movement for driving said hands;

said analog movement and said electrooptic data display means are arranged in said case member means so as to be vertically stacked on each other; and a battery is provided in said case member means for driving said analog display means and said electrooptic data display means so as to be arranged side-by-side with said analog movement and said electrooptic data display means without stacking thereon.

6. The electronic wrist watch according to claim 1, wherein said switch input section comprises a sheet switch means.

7. THe electronic wrist watch according to claim 1, wherein said plate member means comprises a band attaching portion for attaching a watch band.

8. The electronic wrist watch according to claim 1, wherein said electronic circuit, means further comprises reading means for reading the phone number data from the phone number data memorizing means, and dial sound signal producing means for converting the phone number data read by the reading means into a dial sound signal and delivering the dial sound signal to the sound producing unit means.

9. The electronic wrist watch according to claim 1, wherein said plate member means comprises a first member on the side of a surface to be contacted with a user's hand and a second member on the side of a surface on which the switch input section is mounted.

* * * * *

UNITED STATES PATENT AND TRADEMARK OFFICE

CERTIFICATE OF CORRECTION

PATENT NO. : 5,050,138

DATED : Septmber 17, 1991

INVENTOR(S) : YAMADA et al

It is certified that error appears in the above-identified patent and that said Letters Patent is hereby corrected as shown below:

TITLE PAGE

Section [30] Foreign Application Priority Data -

Delete "[U]" after the Japanese Applications

"63-226576" and "1-165294".

Signed and Sealed this

Thirteenth Day of April, 1993

*Attest:*

STEPHEN G. KUNIN

*Attesting Officer*

*Acting Commissioner of Patents and Trademarks*